United States Patent [19]

Levenson

[11] 4,362,584

[45] Dec. 7, 1982

[54] METHOD FOR BINARY PROPELLANT

[75] Inventor: Michael K. Levenson, Tempe, Ariz.

[73] Assignee: Pyrodex Corporation, Shawnee Mission, Kans.

[21] Appl. No.: 183,856

[22] Filed: Sep. 3, 1980

[51] Int. Cl.[3] ..... D03D 23/00

[52] U.S. Cl. ..... 149/109.6; 149/21; 149/71; 149/112

[58] Field of Search ..... 149/109.6, 21, 71, 112

[56] References Cited

U.S. PATENT DOCUMENTS

| | | | |
|---|---|---|---|
| 3,660,546 | 2/1972 | Lövold | 264/3 C |
| 3,729,351 | 4/1973 | Kruse | 149/61 X |
| 3,903,219 | 9/1975 | Stephanoff | 264/3 C |
| 4,008,108 | 2/1977 | Chrisp | 149/60 |

*Primary Examiner*—Stephen J. Lechert, Jr.

[57] ABSTRACT

This invention relates to propellants and in particular to a method for safely forming a binary propellant.

More specifically, this invention relates to a method for safely forming a Binary Propellant useful as a propellant replacement for Black Powder.

1 Claim, No Drawings

METHOD FOR BINARY PROPELLANT

BACKGROUND OF THE INVENTION

Black Powder possesses unique characteristics commending its use as a propellant where a high impulse is needed under conditions of poor confinement and poor ignition.

Unfortunately, however, black powder is dangerous to manufacture and store. Therefore, black powder substitutes have been proposed in the propellant art. An example of such compositions is found in U.S. Pat. No. 4,128,443 to Pawlak and Levenson.

Although the proposed prior art compositions possess safety characteristics, they are still pyrotechnic materials and possess handling and storage hazards.

SUMMARY OF THE INVENTION

It is therefore an object of this invention to provide a method for safely forming a binary propellant capable of being substituted for black powder.

A further object of this invention is to provide a method for safely forming a binary propellant in convenient quantities that can be used as required, eliminating hazardous storage of pyrotechnic material.

These and other objects will become clear through the detailed description of the instant invention.

As used herein, the term Binary Propellant refers to a powdered propellant formed by mixing a powdered oxidizer with a powdered fuel.

DETAILED DESCRIPTION OF THE INVENTION

I have found that safe propellant compositions can be prepared by subjecting a powdered system containing one or more suitable oxidizer agents and a powdered system containing one or more suitable fuels to a mild shear action so as to create a composition intentionally somewhat heterogeneous.

This invention is not concerned with specific chemical compositions. However, the resulting compositions should possess functional and impact insensitivity as well as proper ballistic potential.

The specific technique for accomplishing this mixing is to shake the oxidizers and the fuels in a suitable container for an appropriate period of time.

It is not known why shaking the powdered oxidizers with the powdered fuels produces the desired characteristics in one mixture. It is possible that this action may be associated with simultaneous shear and balling up of the various components.

I have found, for example, that making a binary propellant, of the above description, having an unconfined powder column propagation diameter greater than about one sixteenth of an inch, will reliably ignite and function as a propellant when properly confined.

EXAMPLE

This chemical composition corresponds to example 9 of U.S. Pat. No. 4,128,443 to Pawlak and Levenson.

Potassium Nitrate was sieved minus U.S. standard 200 mesh and mixed with two percent Cab-O-Sil.

| MIXTURE "A" | MIXTURE "B" |
|---|---|
| 7.5 Grams Potassium Nitrate/ Cab-O-Sil<br>1.5 Grams Sodium Benzoate<br>1.0 Grams Flowers of Sulfur<br>Intimately blended in a Mortar and Pestle. | 7.5 Grams Potassium Nitrate/ Cab-O-Sil<br>Shake for 3 seconds in a two fluid ounce bottle with a mixture of:<br>1.5 Grams Sodium Benzoate<br>1.0 Grams Flowers of Sulfur |

RESULTS

Mixture "A" was much easier to ignite than mixture "B".

Mixture "A" had a much smaller unconfined propagation diameter and burned more completely and faster.

In general, manufacturing mixture "A" was much more hazardous than manufacturing "B".

GUN TESTS

Mixture "A" was used as a propellant in both a .44 Caliber muzzle loading pistol and a .50 Caliber muzzle loading rifle. It functioned satisfactorily.

Mixture "B" was satisfactorily used as a propellant in the same weapons as mixture "A".

These results are quite surprising because of the outstanding insensitivity of mixture "B" to the extent that in an unconfined condition mixture "B" would not propagate in a diameter equal to the flash holes in the percussion cap nipple of the weapons.

I claim:

1. A method for preparing a binary propellant having reduced sensitivity which comprises subjecting a mixture of a powdered oxidizing component and a powdered fuel component to mild shear action for a period of time sufficient to produce a heterogeneous propellant composition having an unconfined critical propagation diameter of greater than one-sixteenth inch.

* * * * *